US011280147B2

(12) United States Patent
McGuire

(10) Patent No.: US 11,280,147 B2
(45) Date of Patent: Mar. 22, 2022

(54) MANDREL HEAD FOR WELLHEAD ISOLATION TOOL AND METHOD OF USE

(71) Applicant: Oil States Energy Services, L.L.C., Houston, TX (US)

(72) Inventor: Bob McGuire, Meridian, OK (US)

(73) Assignee: Oil States Energy Services, L.L.C., Houston, TX (US)

( * ) Notice: Subject to any disclaimer, the term of this patent is extended or adjusted under 35 U.S.C. 154(b) by 84 days.

(21) Appl. No.: 16/264,975

(22) Filed: Feb. 1, 2019

(65) Prior Publication Data

US 2019/0264522 A1 Aug. 29, 2019

Related U.S. Application Data

(60) Provisional application No. 62/636,656, filed on Feb. 28, 2018.

(51) Int. Cl.
*E21B 33/03* (2006.01)
*E21B 33/068* (2006.01)

(52) U.S. Cl.
CPC ..... *E21B 33/03* (2013.01); *E21B 33/068* (2013.01)

(58) Field of Classification Search
CPC .... E21B 43/26; E21B 43/2607; E21B 33/068; E21B 33/03
See application file for complete search history.

(56) References Cited

U.S. PATENT DOCUMENTS 6,827,147 B2 * 12/2004 Dallas ..... E21B 33/072 166/360
7,708,079 B2 * 5/2010 McGuire ..... E21B 33/068 166/379
2005/0211442 A1 * 9/2005 McGuire ..... E21B 33/047 166/379

OTHER PUBLICATIONS

"Continuous." Merriam-Webster.com Dictionary, Merriam-Webster, https://www.merriam-webster.com/dictionary/continuous. Accessed Feb. 25, 2021. (Year: 2021).*

* cited by examiner

*Primary Examiner* — Robert E Fuller
(74) *Attorney, Agent, or Firm* — Morgan, Lewis & Bockius LLP

(57) ABSTRACT

An improved mandrel head for use with a wellhead isolation tool for protecting a wellhead. In an exemplary embodiment, the wellhead isolation tool includes a lock assembly with a mandrel head with a longitudinally extending annular sleeve. The inner surface of the mandrel head is connected to the mandrel and adapted to sealingly engage the mandrel. The outer surface of the mandrel head also sealingly engages with a seal pack within the wellhead isolation tool, and the mandrel head is configured such that the point of the connection between the mandrel and mandrel head is axially located below the engagement with the seal pack.

15 Claims, 4 Drawing Sheets

MANDREL HEAD FOR WELLHEAD ISOLATION TOOL AND METHOD OF USE

TECHNICAL FIELD

The present disclosure relates generally to oil or gas wellbore equipment, and, more particularly, to an improved mandrel head for a wellhead isolation tool and wellsite connectors for same.

BACKGROUND

Wellhead equipment utilized in connection with an oil or gas wellbore may be subject to extreme conditions during oilfield operations, such as, for example, cementing, acidizing, fracturing, and/or gravel packing of a subterranean wellbore. Wellhead isolation tools are often used to protect wellhead equipment from excessive pressures, temperatures, and flow rates encountered during such oilfield operations.

An exemplary wellhead isolation tool is adapted to position and secure a mandrel within a wellhead. The mandrel may include a packoff assembly, or is preferably configured to be threadably connected at the lower end of the mandrel to one or more mandrel extensions, at least one of which may include a packoff assembly. The packoff assembly is adapted to sealingly engage an internal bore of the wellhead, in order to isolate the wellhead equipment from fluid or other materials moving through the mandrel to or from the oil or gas wellbore. The mandrel may be required to be adapted such that the packoff assembly can be positioned and secured at different locations in different wellheads.

The mandrel typically includes at its upper end an externally threaded section which threadably connects the mandrel to a mandrel head through an internally threaded section of the mandrel head. That threaded connection helps to ensure that, once the components of the wellhead isolation tool are assembled, the packoff assembly is secured in position. The threaded connection between the mandrel and mandrel head will also typically include sealing elements, such as o-rings, intended to prevent the passage of fluid from the interior of the mandrel through the threaded connection. The mandrel head also typically includes at its upper end an externally threaded section which threadably connects to another element of the wellhead isolation tool. Along with the connection between the mandrel and mandrel head, this threaded connection helps to secure the packoff assembly at the desired location within the wellhead In the field, the performance and reliability of the mandrel head, mandrel, and packoff assembly are often an issue because of the extreme duty cycles experienced by wellhead isolation tools during oilfield operations. For example, during oil or gas wellbore fracturing operations, wellhead equipment may be subject to a fluid or slurry pressure of up to 20,000 psi or more. As a result, the high pressures and flow rates encountered during oil or gas wellbore fracturing operations can test any sealing point and may even cause packoff assemblies to "lift-off" from a sealing surface, allowing the fracturing fluid or slurry to leak or blow by the packoff assembly and into the wellhead equipment. It is important to provide support against external forces applied to the mandrel along the longitudinal axis thereof, in both axial directions. Therefore, what is needed is an apparatus, system, or method that addresses one or more of the foregoing issues, among one or more other issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
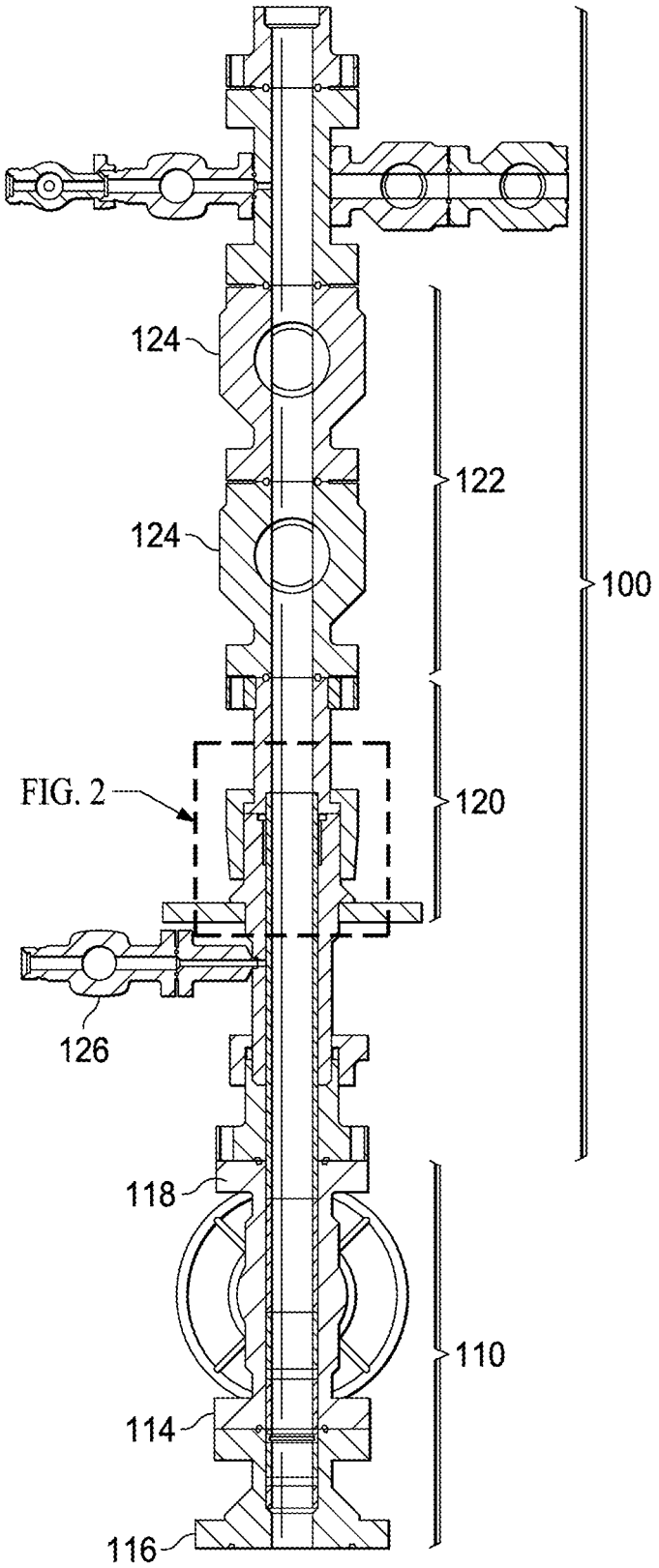
FIG. 1 (PRIOR ART)
FIG. 1 is a diagrammatic view of a prior art wellhead isolation assembly, including a valve stack, a wellhead isolation tool, and a wellhead.

In an exemplary embodiment, FIG. 1 schematically illustrates a wellhead isolation assembly 100 that has been installed on a wellhead 110. The wellhead isolation assembly 100 is adapted to be connected to a wellhead 110, which is, includes, or is part of, one or more wellhead components, such as, for example, a valve 114 and a casing head 116. The wellhead 110 may also include one or more of the following wellhead components: a casing spool, a casing hanger, a tubing head, a tubing hanger, a packoff seal, a valve tree, an isolation valve, choke equipment, or other wellhead components. The wellhead 110 includes an upper flange 118.

The wellhead isolation assembly 100 is installed by an actuator such as a hydraulic cylinder. The wellhead isolation assembly 100 includes a wellhead isolation tool 120, and may include other components, such as a valve stack 122, with one or more valves 124. The valves 124 are adapted to either prevent or allow the flow of a fluid through the valve stack 122 and through the wellhead isolation tool 120. The valve stack 122 is connected to the wellhead isolation tool 120.

Figure 2:
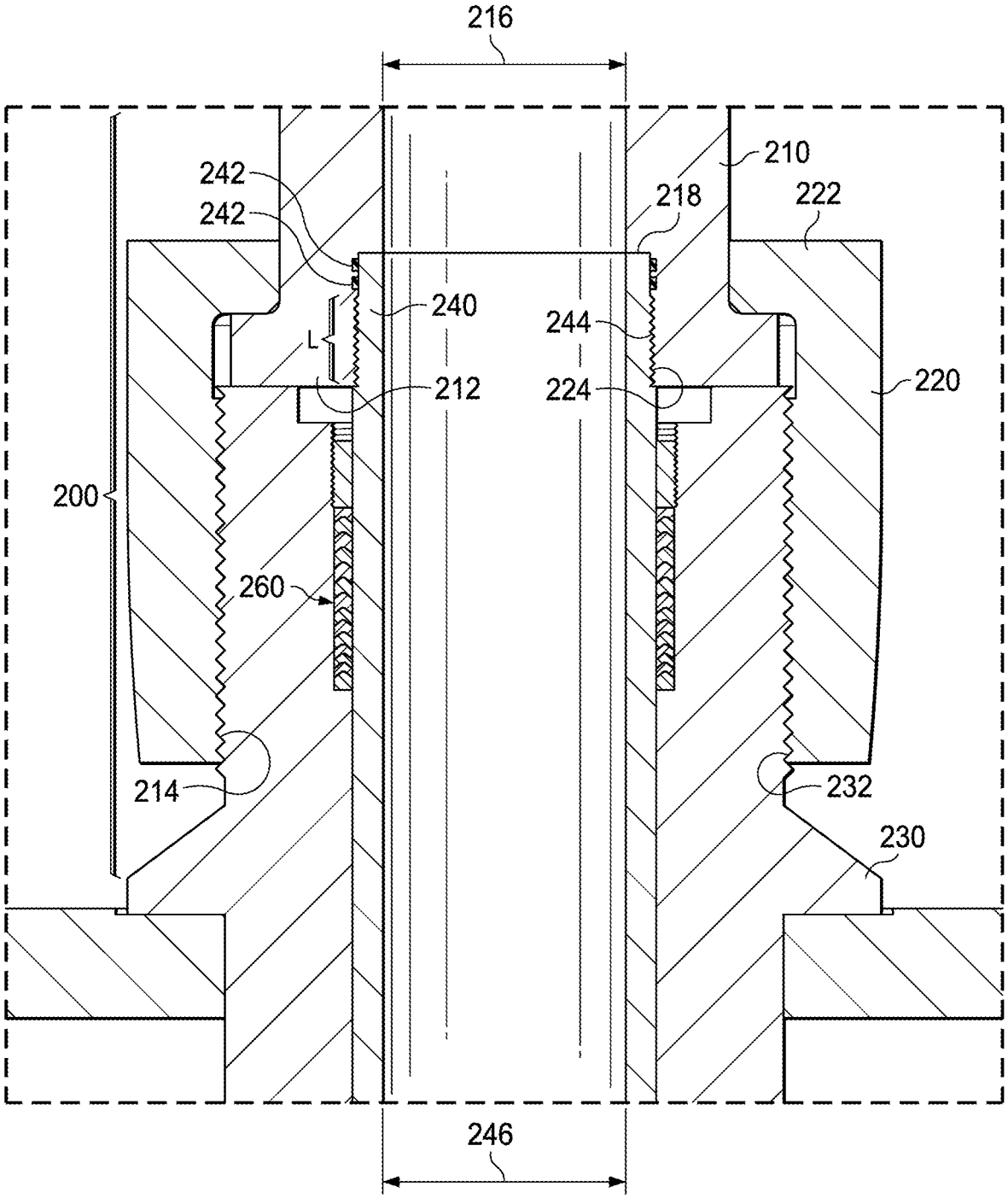
FIG. 2 (PRIOR ART)
FIG. 2 is a cross-sectional view of a prior art lock assembly for the wellhead isolation tool, including a mandrel head, a lockdown wing, a support member, and a mandrel.

FIG. 2 illustrates a lock assembly 200 of a wellhead isolation tool 120 as known in the prior art. The lock assembly includes a mandrel head 210, a lockdown wing 220, a support member 230, and mandrel 240. The mandrel head 210 includes an exterior annular shoulder 212 that engages with an interior annular shoulder 222 of the lockdown wing 220, such that the lockdown wing 220 secures the mandrel head 210 against the support member 230. The lockdown wing 220 also includes internal threads 214 that engage with the external threads 232 of the support member.

The mandrel head 210 includes internal threads 224 that are longitudinally aligned with but radially inward of the exterior annular shoulder 212. Internal threads 224 of mandrel head 210 engage external threads 244 of mandrel 240. The location of this threaded connection is shown as location L in FIG. 2.

Seal pack 260 is located between mandrel 249 and support member 230. Seal pack 260 functions to substantially contain any fluid that passes out of the mandrel at any location below the seal pack. Seal pack 260 may comprise any type of annular seals, but would preferably be chevron seals, also referred to in the industry as "vee packs" or "vee packing."

The inner surface of the mandrel head 210 includes a radially outwardly extending recess 218 that includes the internal threads 224. The radial thickness of the outwardly extending recess 218 of the mandrel head 210 equals the radial thickness of the mandrel 240, such that when the internal threads 224 of the mandrel head 210 engage with the external threads 244 of the mandrel 240, the inner diameter 216 of the mandrel head 210 is equal to the inner diameter 246 of the mandrel 240. This allows constant full-bore access through the wellhead isolation tool 120.

O-rings 242 above the internal threads 224 of the mandrel head 210 and the external threads 244 of the mandrel 240 (location L) help to sealingly engage the two. However, because location L is longitudinally above seal pack 260, in the event that O-rings 242 do not function to sealingly engage mandrel head 210 and mandrel 240, fluid from the interior of the mandrel may pass through that connection, with potentially negative consequences. Reducing the likelihood of such an event is one of the primary objectives of the present invention.

Figure 3:
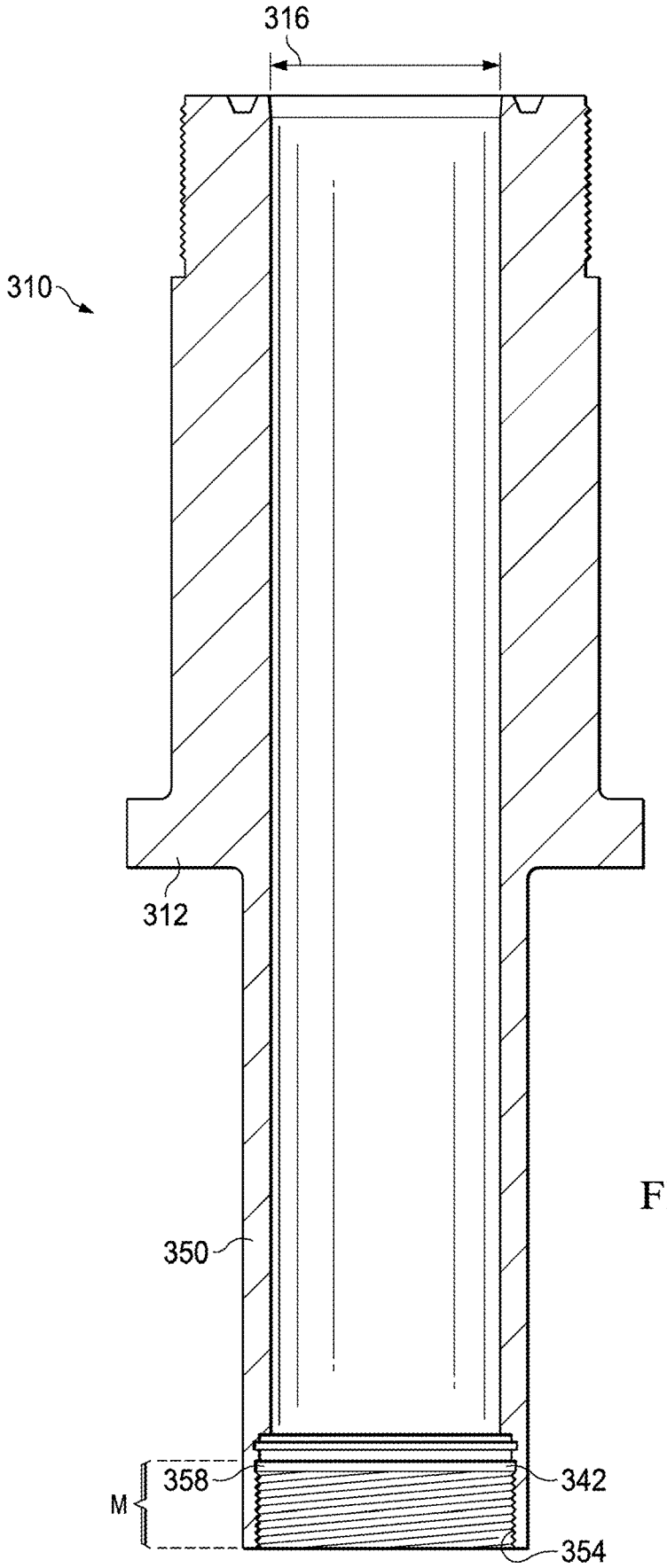
FIG. 3 is a cross-sectional view of an exemplary embodiment of an improved mandrel head.
Figure 4:
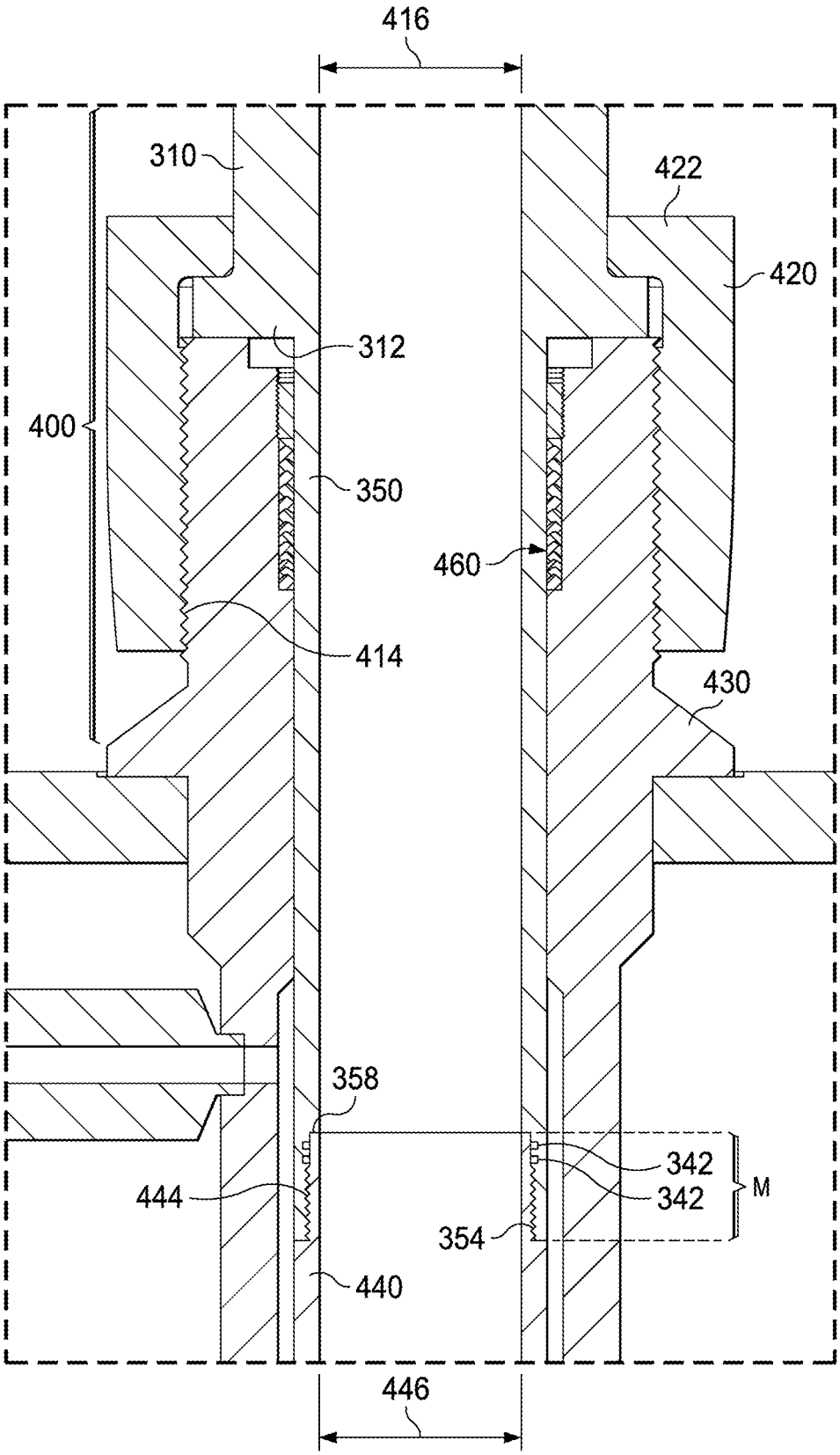
FIG. 4 is a cross-sectional view of a prior art lock assembly for the wellhead isolation tool, including the improved mandrel head of FIG. 3, a lockdown wing, a support member, and a mandrel, according to an exemplary embodiment.

Referring to FIGS. 3 and 4, an improved mandrel head 310 and the improved mandrel head 310 in a lock assembly 400 are illustrated. The improved mandrel head 310 includes an exterior annular shoulder 312 that engages with an interior annular shoulder 422 of the lockdown wing 420.

The improved mandrel head 310 also includes an integral, longitudinally-extending, annular sleeve 350. In contrast with the prior art design, the improved mandrel head 310 includes internal threads 354 at the lower end of the annular sleeve 350 rather than near the shoulder 312. Internal threads 354 of annular sleeve 350 engage external threads 444 of mandrel 440. The location of this threaded connection is shown as location M in FIG. 4.

The inner surface of the annular sleeve 350 includes a radially outwardly extending recess 358 that includes the internal threads 354. The recess 358 accommodates the radial thickness of the mandrel 440 at the external threads 444. Accordingly, when the internal threads 354 of the improved mandrel head 310 engage with the external threads 444 of the mandrel 440, the inner diameter 416 of the improved mandrel head 310 is equal to the inner diameter 446 of the mandrel 440, allowing constant full-bore access. O-rings 342 above the internal threads 354 of the annular sleeve 350 and the external threads 444 of the mandrel 440 (location M) help to sealingly engage the two.

The length of the annular sleeve 350 of the improved mandrel head 310 is selected to be a length that allows the annular sleeve 350 to extend below seal pack 460 when the wellhead isolation tool is fully installed, such that the engagement between the improved mandrel head 310 and mandrel 440 (location M) occurs longitudinally below the seal pack.

As noted above, seal pack 360 functions to substantially contain any fluid that passes out of the mandrel at any location below the seal pack. Accordingly, because annular sleeve 350 is used to extend the connection between mandrel head 310 and mandrel 400 (location M) to a point below seal pack 460, any fluid that passes O-rings 342 should be substantially contained by seal pack 460 and will not pass out of the wellhead isolation tool to the surrounding environment. As noted above, in the prior art device, because location L was located longitudinally above seal pack 460, fluid moving past O-rings 242 could pass out of the wellhead isolation tool to the surrounding environment, with potentially negative consequences.

The improved mandrel head of the present invention is not limited to use with the particular wellhead isolation tool depicted in FIGS. 3 and 4. Instead, the improved mandrel head may be implemented in connection with any configuration of wellhead isolation tool that includes a mandrel and mandrel head. For example, the improved mandrel head of the present invention could be used in connection with the wellhead isolation tools described and claimed in any of U.S. Pat. Nos. 6,179,053, 6,289,993, 9,366,103 or 9,441,441, or U.S. patent application Ser. No. 14/859,702 or 15/903,900, all of which are owned by the applicant and incorporated herein by reference.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A wellhead isolation tool comprising:

a mandrel head comprising:

a continuous one-piece annular sleeve with an upper opening, a lower opening, an inner surface, and an outer surface; and a first throughbore from the upper opening to the lower opening; and a first radially extending flange;

a lockdown mechanism comprising a substantially annular body with internal threads and a second radially extending flange configured to engage the first radially extending flange;

a seal pack surrounding a portion of the outer surface of the annular sleeve at a second axial location;

a mandrel comprising a packoff assembly configured to seal against an inner surface of a wellhead, an upper opening, a lower opening, an inner surface, an outer surface, and a second throughbore from the upper opening to the lower opening;

wherein the inner surface of said annular sleeve is configured to connect to the mandrel at a first axial location; and wherein the second axial location is between the first axial location and the upper opening.

2. The wellhead isolation tool of claim 1, wherein the first axial location is proximate the lower opening.

3. The wellhead isolation tool of claim 1, wherein the second axial location is proximate the upper opening.

4. The wellhead isolation tool of claim 1, wherein the first throughbore has a first inner diameter proximate the upper opening and a recessed area with a second inner diameter proximate the lower opening, and wherein the second inner diameter is larger than the first inner diameter.

5. The wellhead isolation tool of claim 4, wherein within the recessed area of the annular sleeve, the inner surface comprises an internally threaded portion configured to connect to the mandrel.

6. The wellhead isolation tool of claim 5, wherein the one or more grooves are located between the internally threaded portion of the inner surface and the upper opening of the annular sleeve.

7. The wellhead isolation tool of claim 4, wherein within the recessed area of the annular sleeve, the inner surface comprises one or more grooves configured to accommodate a sealing member.

8. The wellhead isolation tool of claim 1, wherein the second throughbore has a third inner diameter that is substantially equal to the first inner diameter of the first throughbore.

9. A method of isolating a wellhead, comprising the following steps:

providing a wellhead isolation tool comprising:

a mandrel head comprising:

a continuous one-piece annular sleeve with an upper opening, a lower opening, an inner surface, and an outer surface; and a first throughbore from the upper opening to the lower opening; and a first radially extending flange; and a lockdown mechanism comprising a substantially annular body with internal threads and a second radially extending flange configured to engage the first radially extending flange;

connecting to the inner surface of the annular sleeve at a first axial location a mandrel comprising a packoff assembly configured to seal against an inner surface of a wellhead, an upper opening, a lower opening, an inner surface, an outer surface, and a second throughbore from the upper opening to the lower opening;

moving the mandrel and mandrel head down through the wellhead, such that the outer surface of the annular sleeve is sealingly engaged with a seal pack at a second axial location; and continuing to move the mandrel and mandrel head down through the wellhead at least until the first axial location is below the second axial location.

10. The method of claim 9, wherein the first axial location is proximate the lower opening.

11. The method of claim 9, wherein the first throughbore has a first inner diameter proximate the upper opening and a recessed area with a second inner diameter proximate the lower opening, and wherein the second inner diameter is larger than the first inner diameter.

12. The method of claim 11, wherein within the recessed area of the annular sleeve, the inner surface comprises an internally threaded portion configured to connect to the mandrel.

13. The method of claim 12, wherein the one or more grooves are located between the internally threaded portion of the inner surface and the upper opening of the annular sleeve.

14. The method of claim 11, wherein within the recessed area of the annular sleeve, the inner surface comprises one or more grooves configured to accommodate a sealing member.

15. The method of claim 9, wherein the second throughbore has a third inner diameter that is substantially equal to the first inner diameter of the annular sleeve.

* * * * *